US007865996B1

(12) United States Patent
Elder et al.

(10) Patent No.: US 7,865,996 B1
(45) Date of Patent: Jan. 11, 2011

(54) SOOTBLOWER WITH PROGRESSIVE CLEANING ARC

(75) Inventors: Rodney H. Elder, Lancaster, OH (US); James H. Hipple, Lancaster, OH (US); Michael P. Michael, Baltimore, OH (US); Robert W. Honaker, Pickerington, OH (US)

(73) Assignee: Diamond Power International, Inc., Lancaster, OH (US)

( * ) Notice: Subject to any disclaimer, the term of this patent is extended or adjusted under 35 U.S.C. 154(b) by 0 days.

(21) Appl. No.: 12/642,210

(22) Filed: Dec. 18, 2009

(51) Int. Cl.
*F23J 3/00* (2006.01)

(52) U.S. Cl. ..... 15/316.1; 15/318

(58) Field of Classification Search ..... 15/316.1, 15/317, 318, 318.1, 319, 315; 122/379, 382, 122/390, 392
See application file for complete search history.

(56) References Cited

U.S. PATENT DOCUMENTS

| | | | | |
|---|---|---|---|---|
| 2,442,045 | A * | 5/1948 | Howse | 15/317 |
| 4,177,539 | A | 12/1979 | Elting | |
| 4,209,028 | A | 6/1980 | Shenker | |
| 4,218,016 | A | 8/1980 | Freund | |
| 4,229,854 | A | 10/1980 | Johnston et al. | |
| 4,248,180 | A * | 2/1981 | Sullivan et al. | 122/390 |
| 4,351,082 | A | 9/1982 | Ackerman et al. | |
| 4,359,800 | A | 11/1982 | Ziels | |
| 4,360,945 | A | 11/1982 | Ackerman et al. | |
| 4,375,710 | A | 3/1983 | Hammond | |
| 4,422,882 | A | 12/1983 | Nelson et al. | |
| 4,492,187 | A | 1/1985 | Hammond | |
| 4,503,811 | A | 3/1985 | Hammond | |
| 4,565,324 | A | 1/1986 | Rebula et al. | |
| 4,567,622 | A | 2/1986 | Ziels | |
| RE32,517 | E | 10/1987 | Nelson | |
| 4,803,959 | A | 2/1989 | Sherrick et al. | |
| 5,048,636 | A | 9/1991 | Roehrs | |
| 5,065,472 | A | 11/1991 | Carpenter et al. | |
| 5,090,087 | A | 2/1992 | Hipple et al. | |
| 5,135,198 | A | 8/1992 | Freund et al. | |
| 5,167,307 | A | 12/1992 | Purcell et al. | |
| 5,320,073 | A | 6/1994 | Silcott et al. | |
| 5,337,438 | A | 8/1994 | Brown et al. | |
| 5,416,946 | A | 5/1995 | Brown et al. | |
| 5,437,295 | A | 8/1995 | Brown et al. | |
| 5,509,607 | A | 4/1996 | Booher et al. | |
| 5,619,771 | A * | 4/1997 | Minic | 15/316.1 |
| 5,675,863 | A | 10/1997 | Holden et al. | |
| 6,575,122 | B2 * | 6/2003 | Hipple | 122/379 |

OTHER PUBLICATIONS

IR-3Z Sootblower Instruction Manual, IM-15035, Dec. 2004.

* cited by examiner

*Primary Examiner*—Dung Van Nguyen
(74) *Attorney, Agent, or Firm*—Brinks Hofer Gilson & Lione

(57) ABSTRACT

A sootblower of the short travel rotary furnace wall type having features which permit indexing of the angular position of the screw tube assembly during successive operating cycles. Indexing of the arc swept by the sootblower nozzle is provided through the use of a novel cam plate component and operating the sootblower in a manner which provides for indexing between operating cycles.

17 Claims, 7 Drawing Sheets

SOOTBLOWER WITH PROGRESSIVE CLEANING ARC

FIELD OF THE INVENTION

The present invention generally relates to a sootblower device for cleaning internal surfaces of large-scale combustion devices such as utility or industrial boilers. More particularly, the present invention is directed to a short travel, retracting rotary type sootblower, which provides indexing between the position of its discharge nozzle between the start of cleaning cycles to reduce thermal stresses placed on internal components of the combustion device.

BACKGROUND AND SUMMARY OF THE INVENTION

To optimize the thermal efficiency of large scale fossil fuel burning heat exchangers or boilers, it is necessary to periodically remove deposits such as soot, slag and fly ash from their interior heat exchanging surfaces. Typically, a number and types of cleaning devices known as sootblowers are mounted to the exterior of the boiler. Periodically they are inserted into the boiler through cleaning ports located in the boiler wall. Positioned on the forward end of the screw tubes or screw tubes assemblies are one or more cleaning nozzles. The nozzles discharge a pressurized fluid cleaning medium, such as air, water, or steam. The high pressure cleaning medium causes deposits of soot, slag, and fly ash to be dislodged from the internal structures of the boiler.

One type of sootblower is known as a short travel retracting rotary type. This type has a screw tube assembly which is inserted into the boiler, and once it reaches its fully extended position, cleaning medium is discharged from the nozzle as it is rotated through a partial arc, full rotation, or multiple full rotations as desired for wall cleaning. The sootblower medium discharged from the nozzle provides the cleaning effect mentioned previously. One very widely utilized design of the above-mentioned sootblower type is manufactured by the assignee of the present invention and is known as a Diamond Power "IR-3Z"™ sootblower device. These devices have operated in a highly reliable and effective manner around the world for many years.

One disadvantage of many sootblower designs is the erosion and thermal stresses caused to internal components of the boiler when their cleaning cycle operates in the same repeated manner during each operation. For the sootblower of the type mentioned previously, once the screw tube assembly is advanced and reaches its fully extended position, the nozzle begins to discharge cleaning medium and rotates through a specified arc or number of revolutions. At the conclusion of the cleaning cycle, the nozzle reaches its set rotational indexed position, at which point the screw tube assembly is retracted. The next operating cycle retraces the path of the prior cycles. When steam is used as a sootblowing medium, steam in the supply circuit piping may condense into liquid water between operating cycles. When the steam valve is opened to cause the steam sootblowing medium to flow through the sootblower at the beginning of a cleaning cycle, an initial pulse of condensate is ejected from the sootblower nozzle. Thereafter, high pressure steam flows through the nozzle until the cleaning medium valve is again shut-off. The initial ejection of the condensate has an undesirable consequence of placing erosion and thermal stresses on the internal components which impacts it. The heat transfer surfaces can tolerate condensate, but when numerous cycles occur in which the same surfaces are repeatedly impacted by condensate, failures of the internal heat transfer components can occur. Accordingly, in many applications it is desirable to index the position at which the sootblower nozzle begins its cleaning cycle so that the same internal surfaces are not struck by condensate at the start of each operating cycle.

Numerous approaches toward providing sootblower nozzle indexing are known. For example, in long retracting sootblowers which discharge cleaning medium as a lance tube is extended and retracted, the cleaning medium path can be displaced between operating cycles. An approach implemented by the assignee of this invention for indexing long retracting sootblowers uses a drive rack for a gear driven type long retracting sootblower which features a mechanism for indexing the phasing of gear drive between operating cycles. This approach is described in the assignee's U.S. Pat. No. 4,803,959. Other types of indexing mechanisms are known, for example, some use gear drives having ratcheting indexing components.

While many approaches toward providing indexing of sootblower operating cycles are known, these strategies are not adaptable for modification to existing short travel retracting rotary sootblowers.

In accordance with the present invention, these inventors have found that modifications of the existing IR-3Z™ sootblower components coupled with modifications of the control schedule of the device provide the desirable indexing feature. By preferably providing at least four different rotated start positions for the sootblowing start cycle, the erosion effects of condensate ejection can be distributed over multiple internal surfaces, reducing the likelihood of boiler component damage. The principles of this invention may be implemented as a modification to existing sootblowers or in newly constructed sootblower assemblies.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
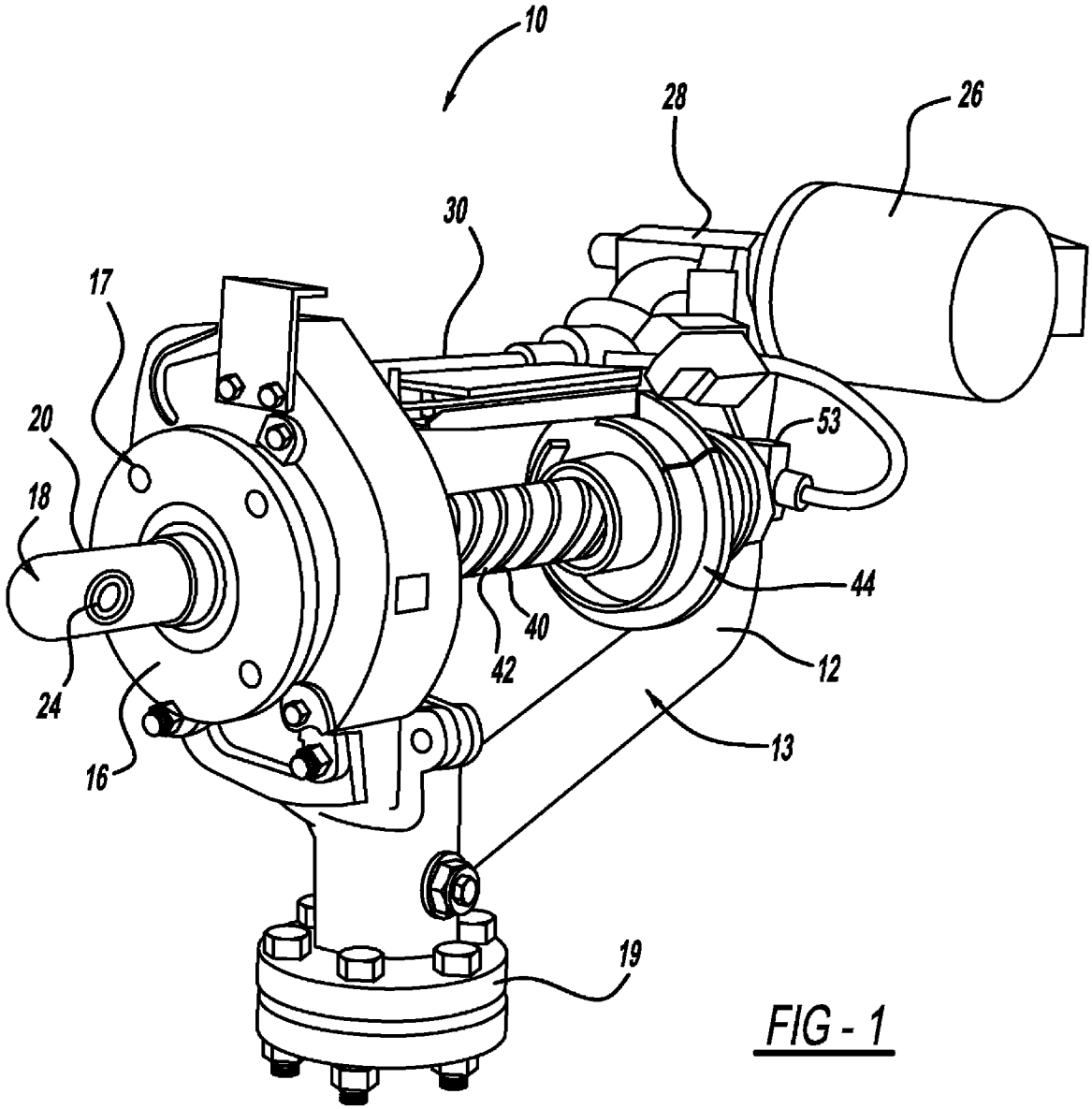
FIG. 1 is a pictorial view of a short retracting rotary sootblower in accordance with the prior art which may be modified to incorporate the features of the present invention.
Figure 2:
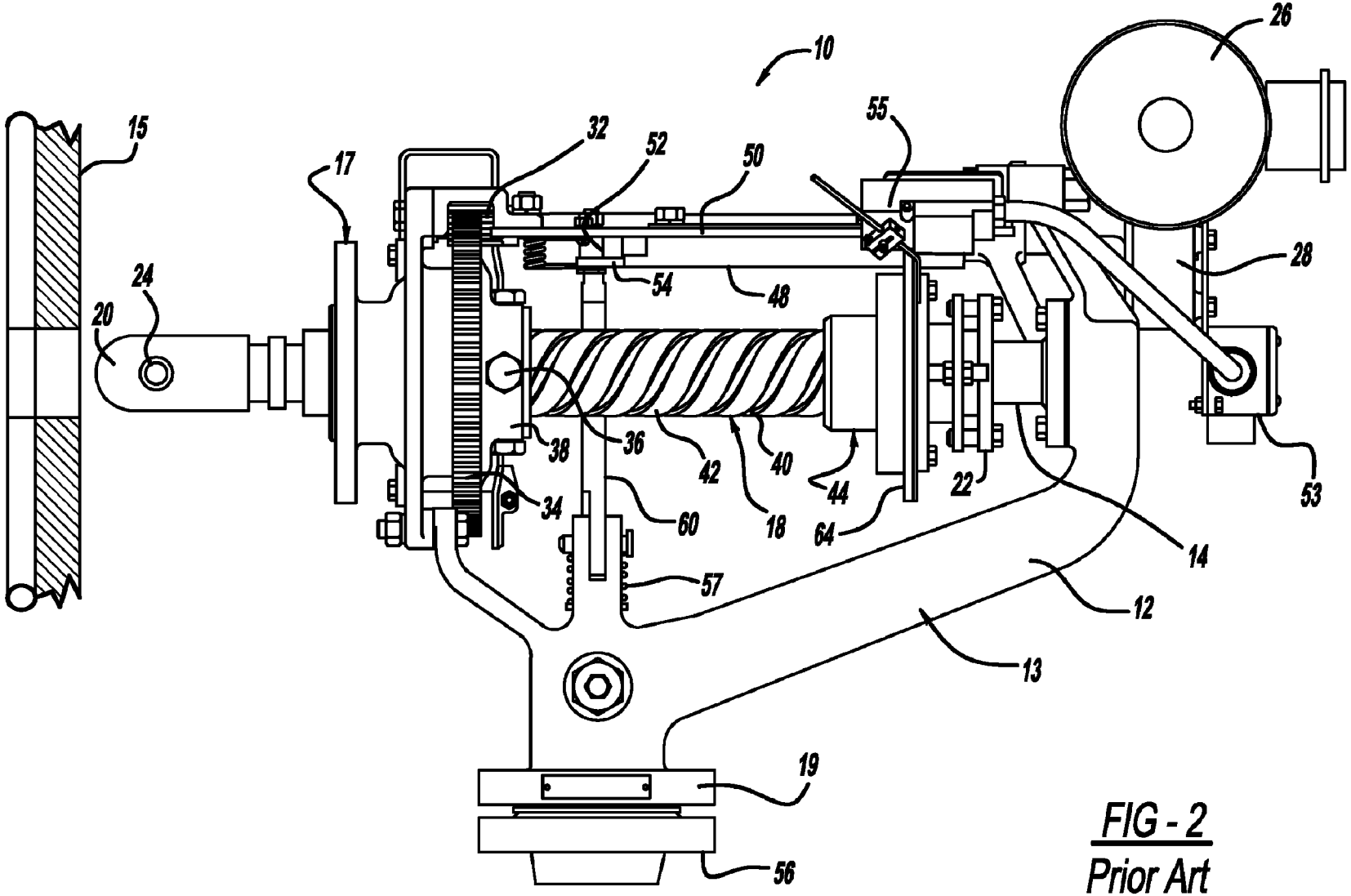
FIG - 2 Prior Art
FIG. 2 is a side elevational view of a short retracting rotary sootblower in accordance with the prior art which may be modified to incorporate the features of the present invention.
Figure 2A:
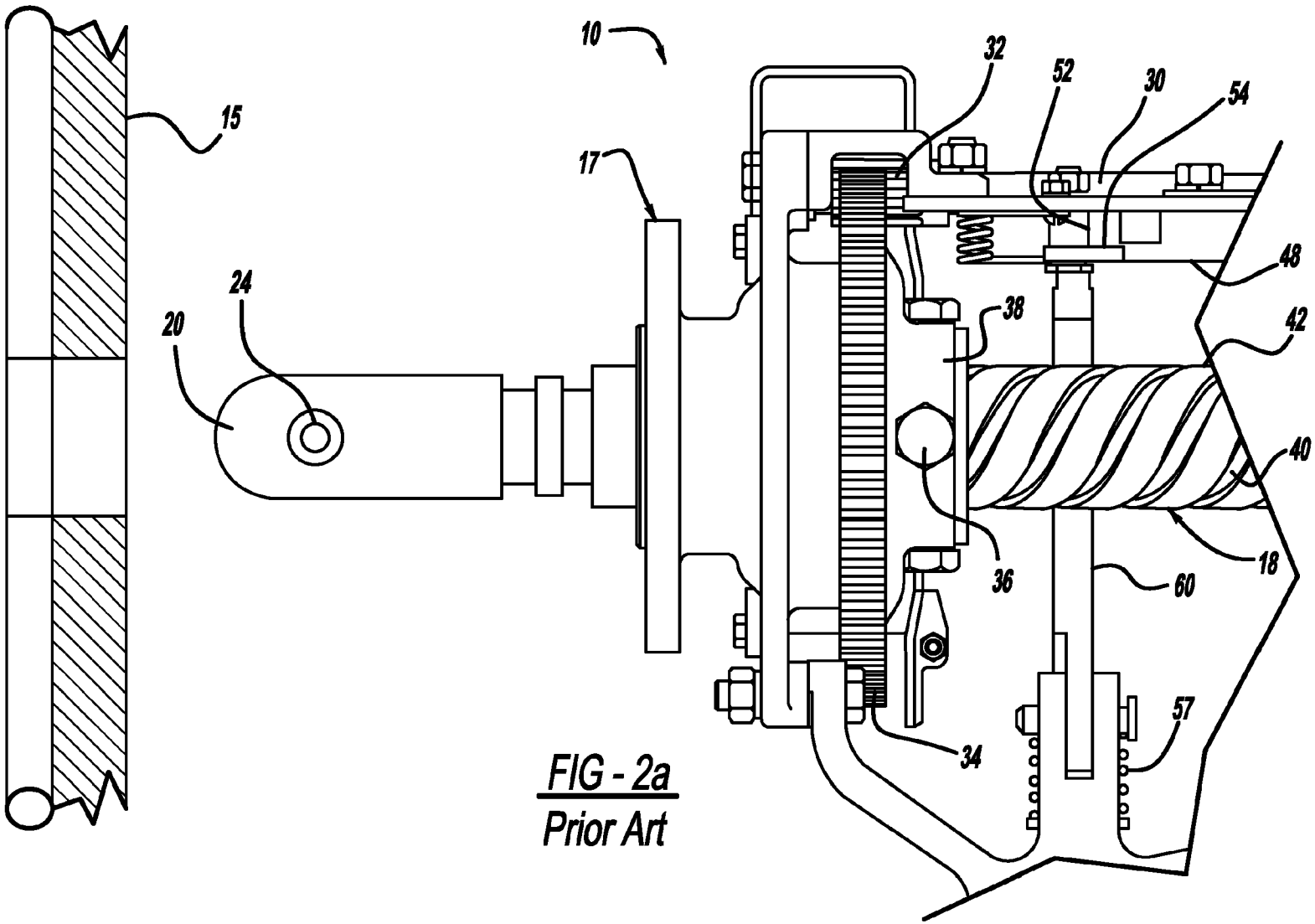
FIG - 2a Prior Art
FIG. 2*a* is an enlargement of a portion of the short retracting rotary sootblower as shown in FIG. 2.

FIGS. 1, 2, and 2*a* show a complete furnace wall sootblower in accordance with the prior art which may be modified to incorporate the features of the present invention. The illustrated sootblower is known in the industry as a short travel, retracting rotary sootblower which is designated by reference number 10. This type of sootblower is primarily used for cleaning furnace wall tubes, and an example of the design is designated by the Assignee of this invention as an "IR-3Z"™ blower assembly. FIGS. 1, 2, and 2*a* show the basic elements of sootblower 10. Gooseneck assembly 13 acts as a frame member to provide support for the major components of sootblower 10. Gooseneck assembly 13 includes gooseneck tube 12 which conducts sootblowing cleaning medium. Feed tube 14 is mounted to gooseneck valve assembly 13 and conducts the blowing medium which is typically steam for the cleaning function, controlled by internal poppet valve assembly 19, as will be described in more detail in the following description. Screw tube assembly 18 includes nozzle extension 20 which is a hollow tube which over fits feed tube 14 in a telescoping manner. Nozzle extension 20 may be provided in various lengths depending on the intended cleaning application. Packing gland 22 provides a fluid seal between the nozzle extension 20 and feed tube 14 such that the flow of blowing medium within feed tube 14 is conducted into nozzle extension 20 without significant leakage between the tubes. The cleaning medium flows through the interior hollow cavities of feed tube 14 and nozzle extension 20, and is ejected within the boiler through nozzle 24.

Figure 3:
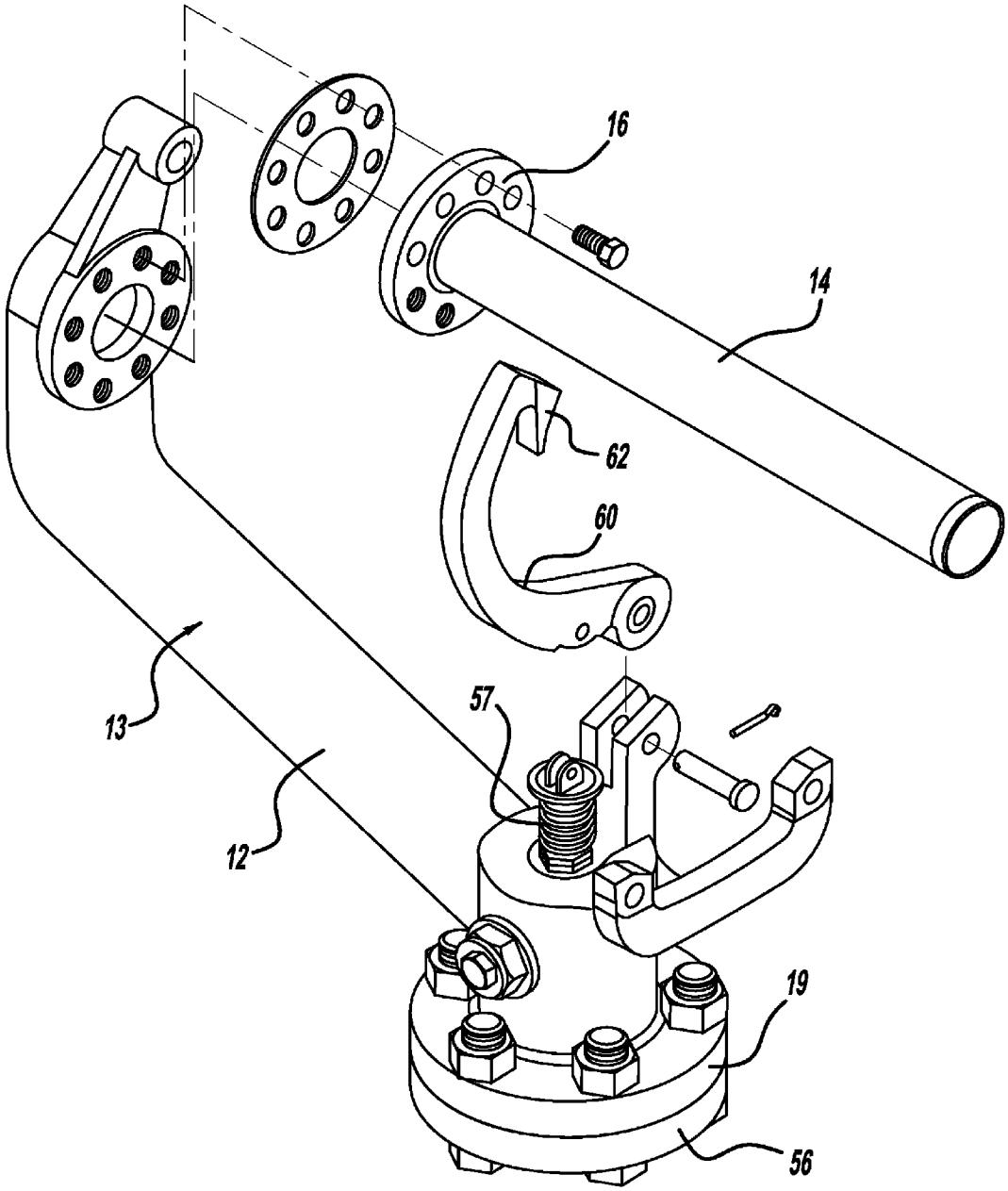
FIG - 3 Prior Art
FIG. 3 is an exploded pictorial view of the gooseneck valve assembly and feed tube of the sootblower shown in FIGS. 1 and 2.

FIG. 3 shows in detail, feed tube 14 which is mounted to gooseneck tube 12 at flange 16.

Sootblower 10 is mounted to the boiler wall 15 (shown in FIGS. 2 and 2*a* in a simplified form) by front bracket assembly 17. When sootblower 10 is operated, nozzle extension 20 is extended into the furnace interior (the area to the left of boiler wall 15 as shown in FIGS. 2 and 2*a*) and, when cleaning is completed, it is withdrawn. During cleaning, nozzle 24 is rotated to sweep an arc of cleaning medium spray.

Drive motor 26 powers sootblower 10 through a gear reducer 28. Rotation of drive motor 26 is converted to rotation of gear shaft 30 which in turn rotates drive pinion gear 32. Drive pinion gear 32 meshes with hub gear 34 mounted to hub 38. Screw tube 42 passes through hub gear 34 and hub 38. Pins 36 extend inwardly from hub 38 and engage with the helical grooves 40 formed on the outside surface of screw tube 42. Screw tube 42 is attached to nozzle extension 20.

Figure 4:
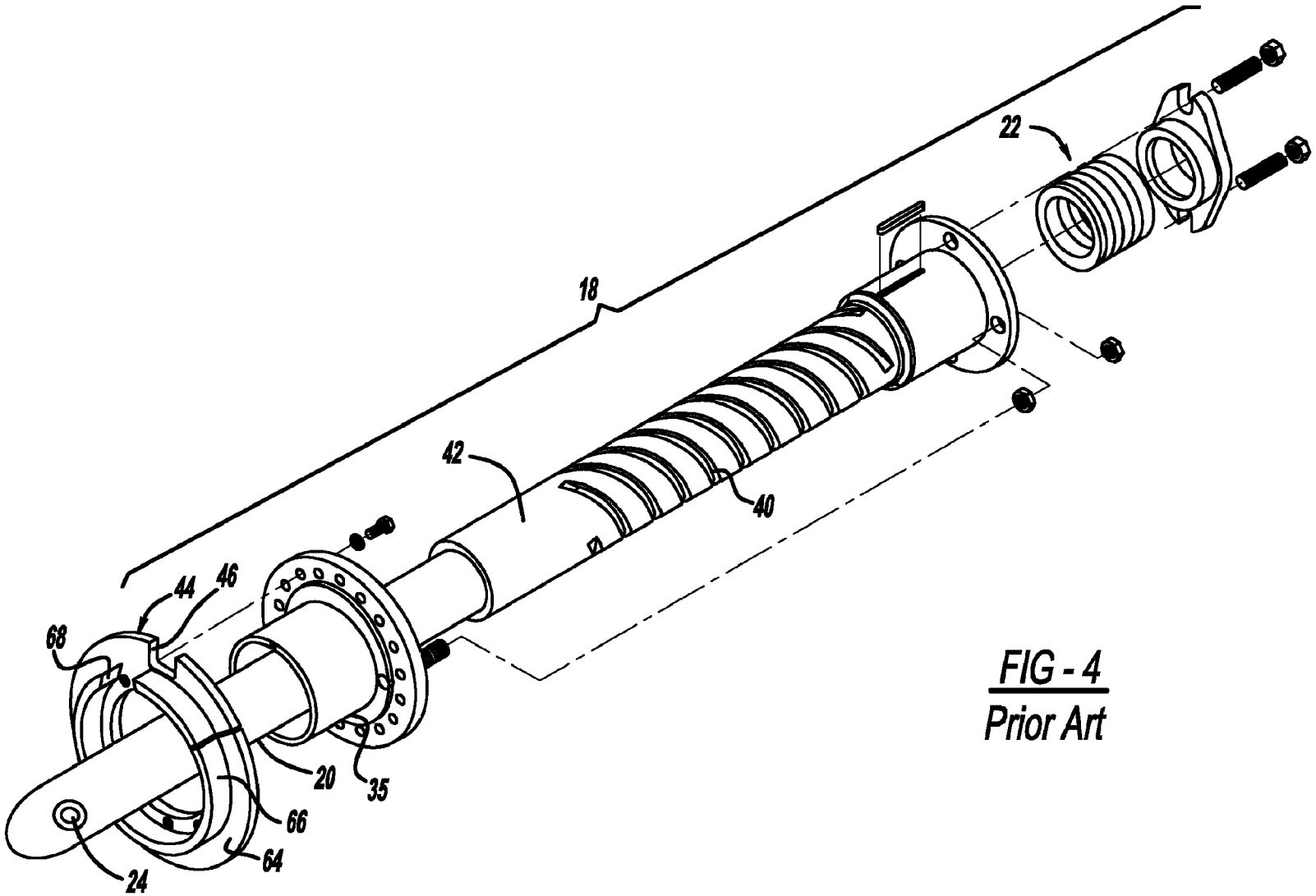
FIG - 4 Prior Art
FIG. 4 is an exploded pictorial view of the screw tube assembly screw drive assembly of the sootblower shown in FIGS. 1 and 2.
Figure 5A:
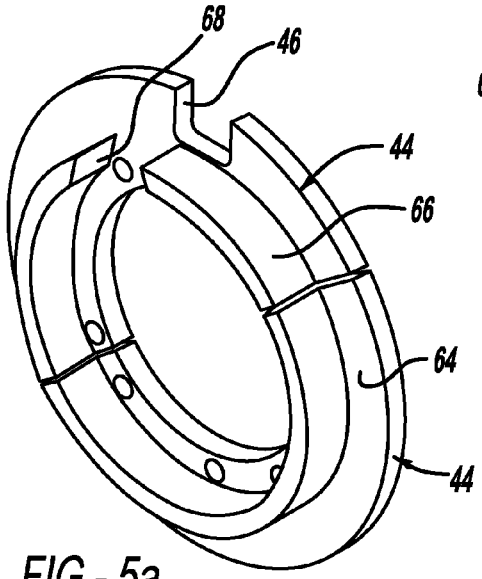
FIGS. 5*a* and 5*b* illustrate cam plates for sootblowers in accordance with the prior art of the type shown in FIGS. 1 through 4.
Figure 5B:
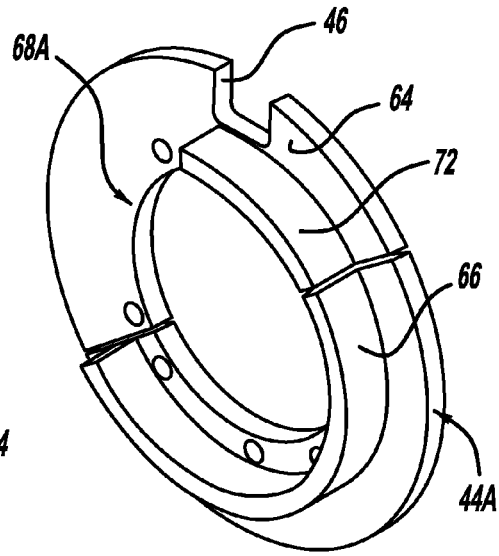
Figure 6A:
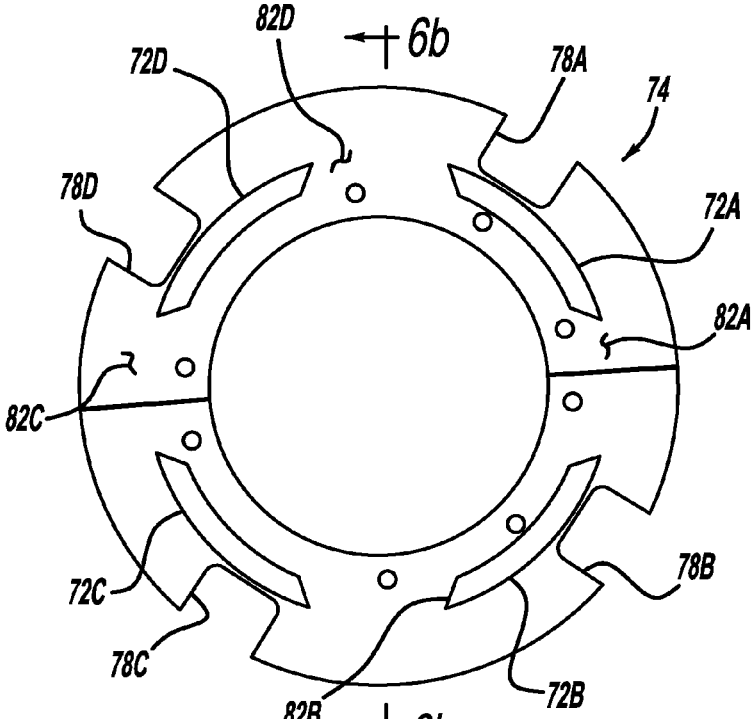
FIGS. 6*a* and 6*b* illustrate a cam plate for a sootblower in accordance with the present invention.
Figure 6B:
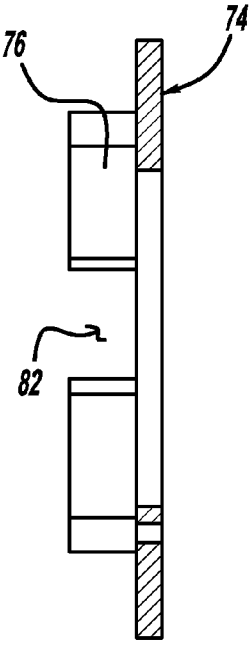

Cam plate 44 shown by FIGS. 4, 5*a* and 5*b* is affixed to the proximal end of screw tube 42 via hub 35 adjacent to packing gland 22 and includes, in accordance with conventional designs, a single peripheral notch 46 which engages with an elongated guide bar 48 which is supported by support plate 50. Guide bar 48 has a free end 52 positioned at the front end of the unit such that cam plate notch 46 escapes from engagement with the guide bar 48 at near the fully extended position of screw tube 42.

The extension and retraction movement of screw tube assembly 18 is started by a control command through electric control assembly 53 which activates drive motor 26. Rotation of motor 26 rotates drive pinion gear 32 and hub gear 34. This rotation causes pins 36, which engage with helical grooves 40, to cause screw tube 42 to move from the retracted position shown in FIG. 2 to an extended position. During screw extension movement (between the fully retracted and fully extended positions), screw tube 42 is prevented from rotating due to the engagement between cam plate notch 46 and guide bar 48. When screw tube assembly 18 reaches its fully extended position, cam plate 44 extends past guide bar end 52, and therefore the screw tube 42 is no longer restrained from rotating. At this point, continued rotation of hub gear 34 causes screw tube assembly 18 and consequently nozzle 24 to rotate. Front pawl 54 is spring loaded to engage with cam plate notch 46 and is used to establish a detent for the "park" position of the cam plate 44 to position cam plate notch 46 to reengage with guide bar end 52 when screw tube assembly 18 is being retracted. In the forward direction, the front pawl 54 is spring loaded and slip by the cam notches 46. In the reverse direction of cam plate 44, front pawl 44 stops the cam plate at the correct position for notch 46 to engage with guide bar end 52.

When screw tube assembly 18 reaches its fully extended position and nozzle 24 is rotated through the desired partial rotation arc or number of rotations, drive motor 26 is stopped based on a control input from a timer circuit in electric control assembly 53 and then commanded through the electric control assembly to reverse its rotation. Such reversal allows front pawl 54 to engage with cam plate notch 46 and position it properly to cause it to reengage with guide bar end 52 in the retraction movement. Continued reverse rotation of the motor 26 causes screw tube assembly 18 to return to its fully retracted, parked position, shown in FIG. 2. Limit switch 55 is activated when cam plate 44 reaches its fully retracted position, and provides a control signal to electric control 53 to stop current to drive motor 26 until the next cleaning cycle.

The flow of blowing medium is controlled by mechanically operated valve 19 shown as a poppet type valve. A supply of steam or air or other blowing fluid medium is connected with poppet valve 19 at flange 56 and it is opened to an "on" position and closed to an "off" position by motion of valve trigger 60. Valve trigger 60 is in the shape of a caliper arm and includes an inwardly directed tooth 62. When poppet valve 19 is opened, steam flows through gooseneck assembly 13, into feed tube 14, through nozzle extension 20, and out of nozzle 24.

Cam plate 44 of convention design is best shown with reference to FIGS. 4, 5*a*, and 5*b*, and forms a disc section 64 and a tubular section 66 extending from the disc section. Disc section 64 forms notch 46 described previously. Tubular section 66 includes, in accordance with a conventional design, a single recess (or notch) 68 which is engaged by valve trigger tooth 62. Poppet valve 19 is operated by movement of valve trigger 60. When valve trigger 60 is in a radially outer position which corresponds with tooth 62 riding on the outside surface of tubular section 66, the poppet valve 19 is opened to the "on" position to allow the flow of the fluid cleaning medium. On the other hand, when the valve trigger tooth 62 fits into recess 68 thus moving to a radially inward position, the flow of cleaning medium is stopped through the valve. Valve trigger 60 is biased to the inner (off) position by the force of valve spring 57. The radial extent of recess 68 (or stated another way, the angular length of tubular section 66) can be adjusted such that the cleaning medium discharge occurs some arc segment less than 360° using a cam plate such as cam plate 44*a* shown in FIG. 5*b* in which recess 68*a* has a greater angular extent as compared with recess 68. This is provided for applications where cleaning is only required over a partial arc of rotation of screw tube assembly 18. Tubular section 66*a* as illustrated in FIG. 5*b* provides about 300° of cleaning medium discharge.

It is noted that cam plates 44 and 44*a* may be formed as one-piece articles, or in arc segments as they are illustrated. Multipiece construction provide ease of assembly since a one-piece ring shaped cam plate would need to be inserted over nozzle extension 20, whereas the separate segments can be bolted to hub 35 with the screw tube assembly 18 in its retracted position.

Since the cam plate notch 46 needs to engage and reengage with guide bar 48 at the beginning and end of each operating cycle, the start and stop position of the lance tube nozzle 24 and the position at which cleaning medium discharge occurs, is fixed between operating cycles in the illustrated prior art sootblower 10 described previously.

The above description describes sootblower 10 in accordance with prior art known features. Sootblower 10 modified in accordance with the present invention utilizes cam plate 74 illustrated in FIGS. 6*a*, 6*b*, 7*a*, and 7*b*. Notably, cam plate 74 includes more than one of the peripheral notches 78, designated as notches 78*a*, 78*b*, 78*c*, and 78*d* which engage guide bar 48, as does notch 46 in the prior art cam plate 44. This enables cam plate 74 and consequently sootblower screw tube assembly 18 to be moved to more than one angularly indexed position during its extension and retraction motion (and importantly, its start position). Cam plate tubular section 72 is segmented into sections 72*a-d* and has a number of discontinuities or recesses 82*a*, 82*b*, 82*c*, and 82*d* which, like tubular section 66 of cam plate 44, controls the flow of cleaning medium discharge through poppet valve 19. It is necessary to move poppet valve 19 to a closed position when the sootblower reaches its parked and indexed position during retraction and extension of screw tube assembly 18. For this reason, tubular section recesses 82 are equal in number to the number of cam plate notches 78 provided. Cam plate 74 is a direct replacement for cam plate 44 used in existing sootblower 10. It should be noted that other configurations of cam plate 74 may be provided. In accordance with this invention, more than one notch 78 is needed to implement the features of the present invention. However, various numbers of notches 78 and therefore indexed start positions can be provided. For example, two, three, or more notches 78 could be provided, with the notches 78 and 82 at equal angular arc spacings.

In operation, cam plate 74 is positioned in its beginning park position with one of notches 78*a*, 78*b*, 78*c*, and 78*d* engaged with guide bar 48. Drive motor 26 is actuated to cause cam plate 74 to advance along guide bar 48 as screw tube assembly 18 is being extended into the boiler. When cam plate 74 escapes from engagement with guide bar 48 near its fully extended position, cam plate 74, and consequently screw tube assembly 18, are caused to rotate. Valve trigger 60 engages with recesses 82*a-d* as the cam plate is rotated. Drive motor 26 is actuated over a time period established by a timer unit within electric controller assembly 53. When the rotation of nozzle extension 20 occurs through a desired arc (or full rotations), drive motor 26 is caused to be deenergized to stop the rotation when cam plate 74 is at some angular position displaced from that of the first notch 78*a* (or another notch engaged in the preceding cycle). Since the forward/reverse motion is based on a timer control, the timer is set to cause cam plate 74 to overshoot the desired parked position slightly. The motor 76 is reversed to position the cam plate 74 (as explained in more detail below) and is stopped in its rotation so that another one of notches 78*b*, 78*c*, or 78*d* is positioned to engage with guide bar 48. Once the desired position is achieved, the drive motor 26 causes the cam plate 74, at one of notches 78*a* through 78*d* to reengage with the guide bar 48. In successive operating cycles, drive motor 26 is energized through a predetermined time period which causes rotation again to a position just past that corresponding with the notch 78*a* through 78*d* displaced from the immediately preceding cycle. At full retraction, drive motor 26 is deenergized by activation of limit switch 55.

It is necessary for the flow of steam through sootblower 10 to be stopped when cam plate 74 is at a "start" position at which one of notches 78*a*, 78*b*, 78*c*, or 78*d* is positioned to engage with guide bar end 52. Accordingly, cam tubular sections 72*a-d* have recesses 82*a-d* equal in number to those of notches 78*a-d*.

Figure 7A:
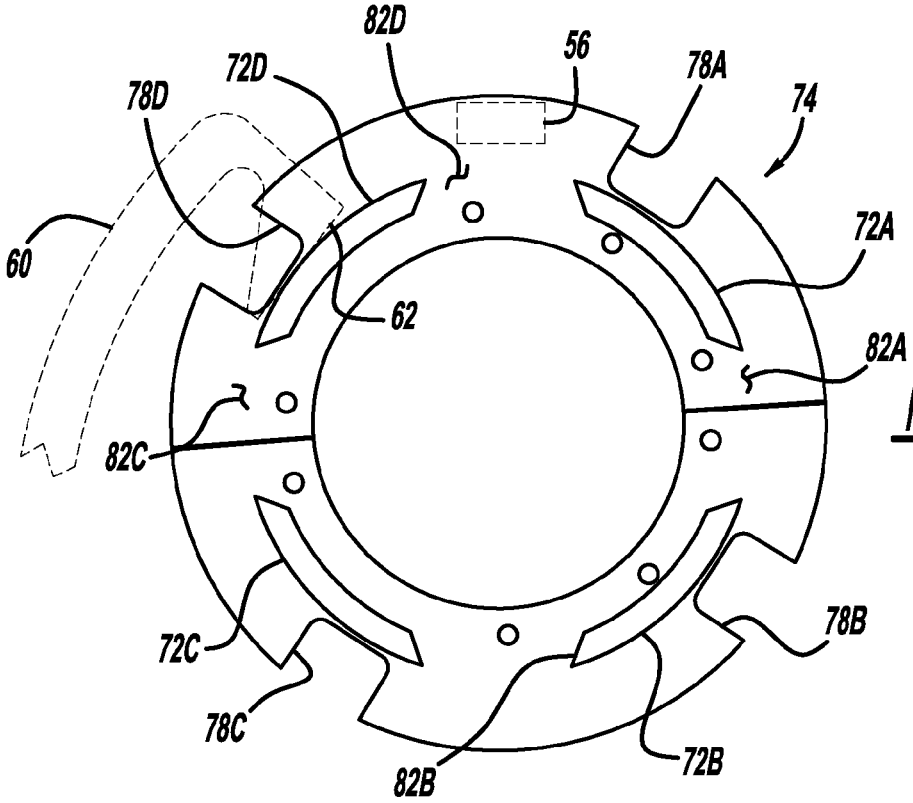
FIGS. 7*a* and 7*b* illustrate the cam plate in accordance with this invention as it interacts with other elements of a short travel rotary sootblower assembly.
Figure 7B:
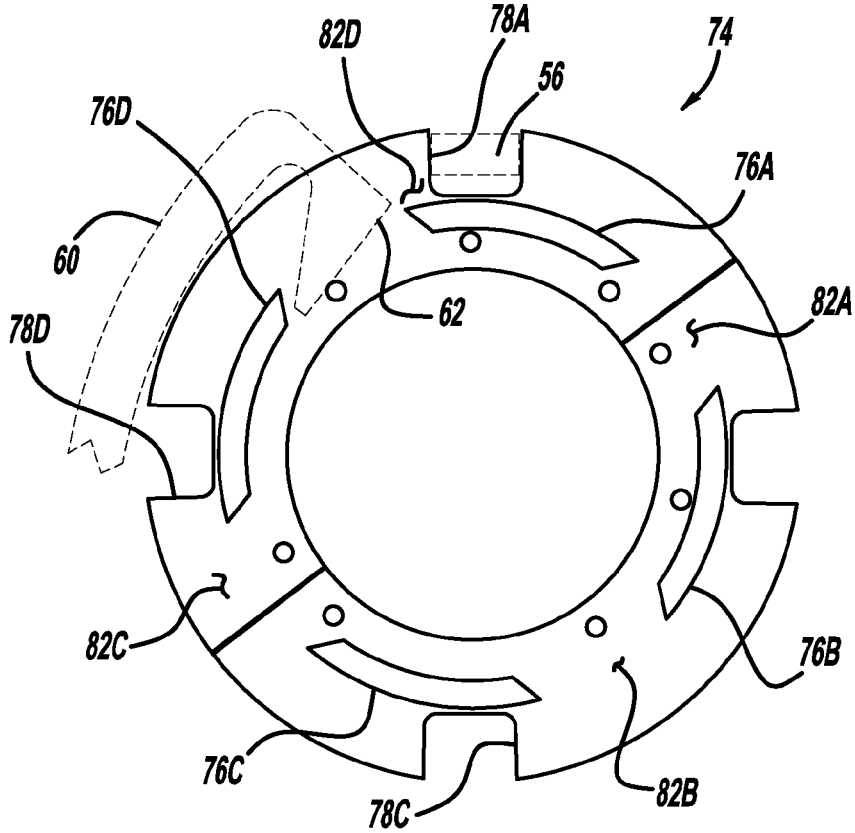

FIGS. 7*a* and 7*b* illustrate the interaction between valve trigger 60 and tubular sections 72*a-d*. As shown in FIG. 7*a*, valve trigger 60 is moved to its radially outer position, overcoming the force of spring 57 and riding on the outside of tubular sections 72*a-d*. This position opens the flow of steam through poppet valve 19. When the rotation has gone through a desired cleaning arc, the electronic control timer signals the device to stop rotation and reverse. When cam plate 74 is stopped and its rotation is reversed, trigger tooth 62 contacts the associate tubular section 72 *a-d* and continued reverse rotation causes valve trigger 60 to move to its radially inner position which stops the flow of cleaning medium as it moves into one of recesses 82 *a-d*. This interaction also acts as a "one-way ratchet" which positions cam plate 74, such that guide bar end 52 is aligned with one of notches 78*a-d*.

Cam plate 74 is illustrated in FIGS. 6*a*, 6*b*, 7*a*, and 7*b* and provide four possible indexed park positions for the sootblower nozzle corresponding with each of the four notches 78*a-d*. This cam plate 74 provides rotation set positions at 90° spaced increments. For example, in operation, cam plate 74 can provide more or less than 360° of rotation for each operating cycle which would result in a different one of the notches 78*a-d* engaging with guide bar end 50 at each successive operating cycle. It is within the scope of the present invention to provide differing numbers of notches 78*a*. In order to provide the features of the invention, at least two of such notches 78 should be provided. The number of recesses 82 in tubular section 72 are equal to those of notches 78.

As is the prior art cam plate 44, cam plate 74 may be made in a one piece or multipiece construction as illustrated by the figures.

While the above description constitutes the preferred embodiment of the present invention, it will be appreciated that the invention is susceptible to modification, variation and change without departing from the proper scope and fair meaning of the accompanying claims.

The invention claimed is:

1. A retracting rotary sootblower for blowing a fluid cleaning medium against internal surfaces of a combustion device, comprising:

a screw tube assembly which can be extended into and retracted from the combustion device and slidably overfitting a feed tube, the screw tube assembly having a nozzle extension and a screw tube having helical grooves;

a nozzle at an end of the nozzle extension for discharging the cleaning medium;

a cleaning medium valve having a valve trigger for controlling the flow of the cleaning medium between on and off positions;

a frame for supporting the screw tube assembly, the feed tube, and the valve;

a hub mounted to the frame and driven to rotate and having pin means for engaging the helical grooves;

a motor drive for rotating the hub;

a guide bar mounted to the frame;

a cam plate mounted to an end of the screw tube assembly and having a plurality of peripheral notches for engaging the guide bar, and one or more segments engaging with the valve trigger to actuate the valve trigger to control the valve between the on and off positions; and an electric controller for operating the motor drive to rotate the hub causing the screw tube assembly to be extended through the interaction between the helical grooves and the pin means with a first of the cam plate peripheral notches engaging the guide bar, and upon extension of the screw tube assembly, the first of the cam plate notches escapes from the guide bar and continued rotation of the motor drive causes rotation of the screw tube assembly and the cam plate, and the motor drive reversing rotation and the screw tube assembly and the cam plate stopping at a position of engagement between a second of the notches and the guide bar, whereby the cam plate and the screw tube assembly are indexed to different indexed positions between successive operating cycles.

2. A sootblower in accordance with claim 1 wherein the cam plate forms two of the notches spaced 180 degrees apart about the periphery of the cam plate.

3. A sootblower in accordance with claim 2 wherein the cam segments are tubular segments having a pair of recesses aligned with the notches such that the trigger is moved to control the valve to the off position when the guide bar is aligned with either of the notches.

4. A sootblower in accordance with claim 1 wherein the cam plate forms four of the notches spaced 90 degrees apart about the periphery of the cam plate.

5. A sootblower in accordance with claim 4 wherein the cam segments are tubular segments having four recesses aligned with the notches such that the trigger is moved to control the valve to the off position when the guide bar is aligned with each of the notches.

6. A sootblower in accordance with claim 1 further comprising the electric controller having a timer which can be set to cause the screw tube and the cam plate to be rotated through a desired arc segment or multiple rotations before the motor drive is stopped and reversed in direction, whereby the cam plate is indexed to a desired rotated position at the conclusion of each operating cycle.

7. An indexing kit for a retracting rotary sootblower of the type having a screw tube assembly which can be extended into and retracted from a combustion device and telescopically overfitting a feed tube, a nozzle at an end of the screw tube assembly for discharging the cleaning medium, a cleaning medium valve having a valve trigger for controlling the flow of a cleaning medium, a frame for supporting the screw tube assembly the feed tube and the valve, a nozzle extension coupled with the screw tube having helical grooves, a hub mounted to the frame and driven to rotate and having pin means for engaging the helical grooves, a motor drive for rotating the hub, a guide bar mounted to the frame, the indexing kit comprising:

a cam plate for mounting to an end of the screw tube assembly and having a plurality of peripheral notches for engaging the guide bar, and one or more segments engaging with the valve trigger to actuate the valve trigger to control the valve, and an electric controller for operating the motor drive to rotate the hub causing the screw tube assembly to be extended through interaction between the helical grooves and the pin means with a first one of the cam plate peripheral notches engaging the guide bar, and upon extension of the screw tube assembly, the first of the cam plate notches escapes from the guide bar and continued rotation of the motor drive causes rotation of the screw tube assembly and the cam plate, and the motor drive reversing rotation and stopping rotation of the screw tube assembly and the cam plate at a position of engagement between a second of the notches and the guide bar, whereby the cam plate and the screw tube are indexed to different indexed positions between successive operating cycles.

8. An indexing kit for a sootblower in accordance with claim 7 wherein the cam plate forms two of the notches spaced 180 degrees apart about the periphery of the cam plate.

9. An indexing kit for a sootblower in accordance with claim 8 wherein the cam segments are tubular segments having a pair of recesses aligned with the notches such that the valve trigger is moved to the off position when the guide bar is aligned with both the recesses.

10. An indexing kit for a sootblower in accordance with claim 7 wherein the cam plate forms four of the notches spaced 90 degrees apart about the periphery of the cam plate.

11. An indexing kit for a sootblower in accordance with claim 10 wherein the cam segments are tubular segments having four recesses aligned with the notches such that the valve trigger is moved to the off position when the guide bar is aligned with each of the notches.

12. An indexing kit for a sootblower in accordance with claim 7 further comprising the electric controller having a timer which can be set to cause the screw tube assembly and the cam plate to be rotated through a desired arc segment before the motor drive is stopped and reversed in direction, whereby the cam plate is indexed to a desired rotated position during each operating cycle.

13. A cam plate for a retracting rotary sootblower of the type having a screw tube assembly which can be extended into and retracted from a combustion device and telescopically overfitting a feed tube, a nozzle at an end of the screw tube assembly for discharging the cleaning medium, a cleaning medium valve having a valve trigger for controlling the flow of a cleaning medium, a frame for supporting the screw tube assembly the feed tube and the valve, a nozzle extension coupled with the nozzle assembly having a nozzle extension and a screw tube having helical grooves, a hub mounted to the frame and driven to rotate and having pin means for engaging the helical grooves, a motor drive for rotating the hub, a guide bar mounted to the frame, and an electric controller for operating the motor drive to rotate the hub causing the screw tube assembly to be extended through interaction between the helical grooves and the pin means with a first one of the cam plate peripheral notches engaging the guide bar the cam plate comprising:

the cam plate adapted for mounting to an end of the screw tube assembly and having a plurality of peripheral notches for engaging the guide bar, and one or more segments engaging with the valve trigger to actuate the valve trigger to control the valve, wherein upon extension of the screw tube assembly, the first of the cam plate notches escapes from the guide bar and continued rotation of the motor drive causes rotation of the screw tube assembly and the cam plate, and the motor drive reversing rotation and stopping rotation of the screw tube assembly and the cam plate at a position of engagement between a second of the notches and the guide bar, whereby the cam plate and the screw tube are indexed to different indexed positions between successive operating cycles.

14. A cam plate for a sootblower in accordance with claim 13 wherein the cam plate forms two of the notches spaced 180 degrees apart about the periphery of the cam plate.

15. A cam plate for a sootblower in accordance with claim 14 wherein the cam segments are tubular segments having a pair of recesses aligned with the notches such that the valve trigger is moved to the off position when the guide bar is aligned with both the recesses.

16. A cam plate for a sootblower in accordance with claim 13 wherein the cam plate forms four of the notches spaced 90 degrees apart about the periphery of the cam plate.

17. A cam plate for a sootblower in accordance with claim 16 wherein the cam segments are tubular segments having four recesses aligned with the notches such that the valve trigger is moved to the off position when the guide bar is aligned with each of the notches.

* * * * *